US006877346B1

(12) United States Patent
Finkelstein

(10) Patent No.: US 6,877,346 B1
(45) Date of Patent: Apr. 12, 2005

(54) WALK-IN FREEZER DOOR AND DOORFRAME SYSTEM AND DOORLOCK

(75) Inventor: Burl Finkelstein, Newnan, GA (US)

(73) Assignee: Kason Industries, Inc., Shenandoah, GA (US)

( * ) Notice: Subject to any disclaimer, the term of this patent is extended or adjusted under 35 U.S.C. 154(b) by 0 days.

(21) Appl. No.: 10/045,373

(22) Filed: Jan. 15, 2002

(51) Int. Cl.[7] ..... E05B 65/10
(52) U.S. Cl. ..... 70/92; 70/134; 292/DIG. 71; 292/DIG. 59; 292/92
(58) Field of Search ..... 292/92, DIG. 65, 292/DIG. 71, DIG. 59, DIG. 38; 70/92, 129, 70/134

(56) References Cited

U.S. PATENT DOCUMENTS

| | | | | | |
|---|---|---|---|---|---|
| 1,916,848 | A | * | 7/1933 | North | 292/DIG. 71 X |
| 2,001,740 | A | * | 5/1935 | McPherson | 292/DIG. 59 X |
| 2,153,819 | A | * | 4/1939 | Van Voorhees | 292/DIG. 59 X |
| 2,193,488 | A | | 3/1940 | Morley et al. | 200/55 |
| 2,265,691 | A | * | 12/1941 | Hogg | 292/DIG. 59 X |
| 3,465,557 | A | * | 9/1969 | Ryder | 70/139 |
| 3,652,113 | A | * | 3/1972 | Odend'hal et al. | 292/DIG. 71 X |
| 3,678,716 | A | * | 7/1972 | Cobb | 70/92 |
| 4,099,754 | A | * | 7/1978 | Hoebing | 292/DIG. 65 X |
| 4,203,622 | A | * | 5/1980 | Cook et al. | 292/DIG. 71 X |
| 4,341,408 | A | * | 7/1982 | Blevins | 292/150 |
| 4,475,364 | A | * | 10/1984 | Frank | 70/139 |
| 4,613,176 | A | | 9/1986 | Kelly | 292/201 |
| 4,635,977 | A | * | 1/1987 | Yamada | 292/DIG. 71 X |
| 4,669,282 | A | * | 6/1987 | Hoyt et al. | 70/129 |
| 5,152,564 | A | | 10/1992 | Martineau | 292/288 |
| 5,456,505 | A | * | 10/1995 | Yamada | 292/DIG. 71 X |
| 5,490,697 | A | * | 2/1996 | Surko, Jr. | 292/DIG. 71 X |
| 5,582,443 | A | * | 12/1996 | Finkelstein et al. | 292/DIG. 71 X |
| 6,112,471 | A | | 9/2000 | Welch et al. | 49/503 |
| 6,354,119 | B1 | * | 3/2002 | Molzer | 292/DIG. 59 X |
| 6,526,788 | B1 | * | 3/2003 | Finkelstein et al. | 70/129 |

* cited by examiner

*Primary Examiner*—Suzanne Dino Barrett
(74) *Attorney, Agent, or Firm*—Baker Donelson

(57) ABSTRACT

A walk-in freezer door system has a doorjamb with sheets of metal covering a body of thermal insulation. A door is mounted to the doorjamb. A deadbolt housing is mounted to the outside of the doorjamb with a deadbolt mounted for reciprocal movement within the housing between a door locked and a door unlocked position. A handle is rotatably positioned inside of the doorjamb from which a shaft extends into the deadbolt housing and into operative association with the deadbolt. A longitudinal portion of the handle shaft is made of a low thermal conductive plastic. A keeper is mounted to the door in a position to receive the deadbolt with the door located within the doorjamb.

1 Claim, 5 Drawing Sheets

WALK-IN FREEZER DOOR AND DOORFRAME SYSTEM AND DOORLOCK

TECHNICAL FIELD

This invention relates generally to walk-in freezers and particularly to walk-in freezer door and doorframe systems and locks therefor.

BACKGROUND OF THE INVENTION

Commercial coolers and freezers today are sufficiently large to accommodate workers inside them. Access is provided by a doorway having a door hingedly mounted in a doorframe to the doorjamb. The doorjamb often is simply that portion of the cooler wall that defines the doorway. Usually, however, the side of the doorjamb to which the door is mounted has strengthening supports.

Freezer door and doorframe systems are typically equipped with door locks. These locks serve to keep the door securely closed for temperature control and security. The lock may simply be a latch mounted on the door that engages a strike mounted on the doorjamb. In other cases the lock is a key operated type. For safety, the freezer locks have been designed to be operated from inside the freezer as well as from outside. The lock is usually key operated, often on a pull handle that is mounted to a magnetically gasketed door.

A persistent problem associated with freezer door locks has been their propensity to freeze up. Operation of the door is such so that the cold inside surface of the door is moved into the warmer ambient air and causes condensation to form. Condensed water covers and permeates the lock mounted to the door. When the door is closed the moisture that has permeated the lock can freeze and prevent its operation. This not only makes lock operation more difficult but can create a hazardous situation if one locked inside cannot free the lock mechanisms.

Accordingly, it is seen that a need has long existed for a walk-in freezer door and doorframe system and door lock that is substantially less likely to freeze and jam and yet maintains thermal integrity of the doorway. Thermal integrity or minimized thermal conduction is important to reduce the cooling of the outside components of the lock. If the cold is transferred through the wall, the outside components get wet with condensation, causing wetness, corrosion and possible hazardous or unfavorable conditions.

It thus is to the satisfaction of such need that the present invention is primarily directed.

SUMMARY OF THE INVENTION

In a preferred form of the invention a walk-in freezer has a doorjamb made of sheets of metal that encase a body of thermal insulation. A door is mounted to the doorjamb, and a deadbolt housing is mounted on the outside of the doorjamb. A deadbolt is mounted for reciprocal movement within the housing between a door locked and a door unlocked portion. A handle is rotatably positioned inside of the doorjamb from which a shaft extends into the deadbolt housing and into operative association with the deadbolt. A longitudinal portion of the handle shaft is made of a low thermal conductive plastic. A keeper is mounted to the door in a position to receive the deadbolt with the door located closed within the doorjamb.

In another preferred form of the invention a lock for a walk-in freezer door comprises a deadbolt assembly that has a housing adopted to be mounted on a cooler doorjamb and a deadbolt mounted for reciprocal movement within the housing between a door locked and a door unlocked position. Means are provided that is manually accessible from inside the cooler for moving the deadbolt and which includes a rotatable shaft, a longitudinal portion of which is made of low thermal conductivity material. The lock includes a keeper that is adapted to be mounted on a door in a position to receive the deadbolt with the door located in its closed position.

DETAILED DESCRIPTION

Figure 1:
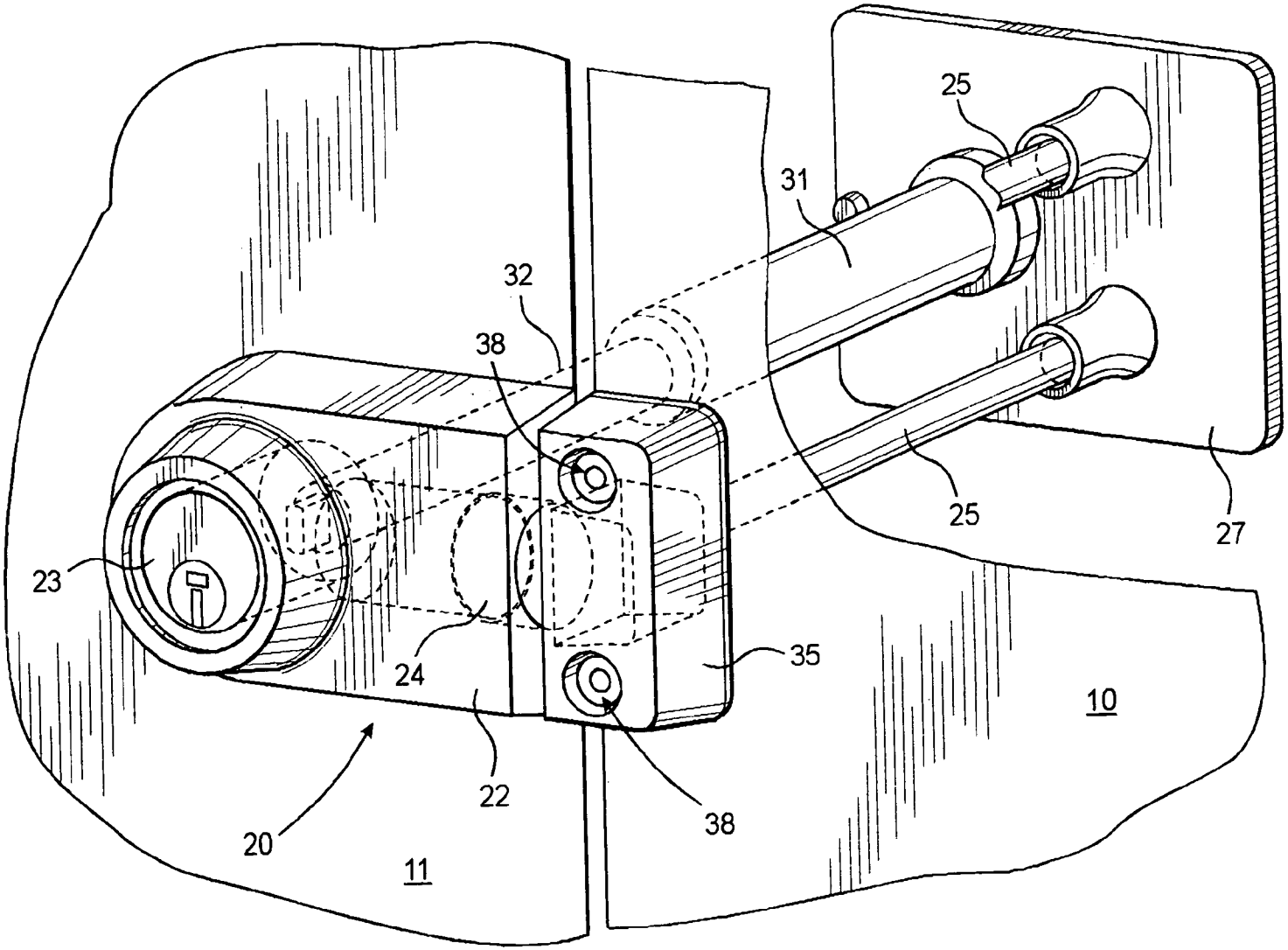
FIG. 1 is a perspective view of a portion of the outside of a walk-in freezer door and doorframe with a key-operated deadbolt type lock and keeper that embodies the invention in a preferred form.
Figure 2:
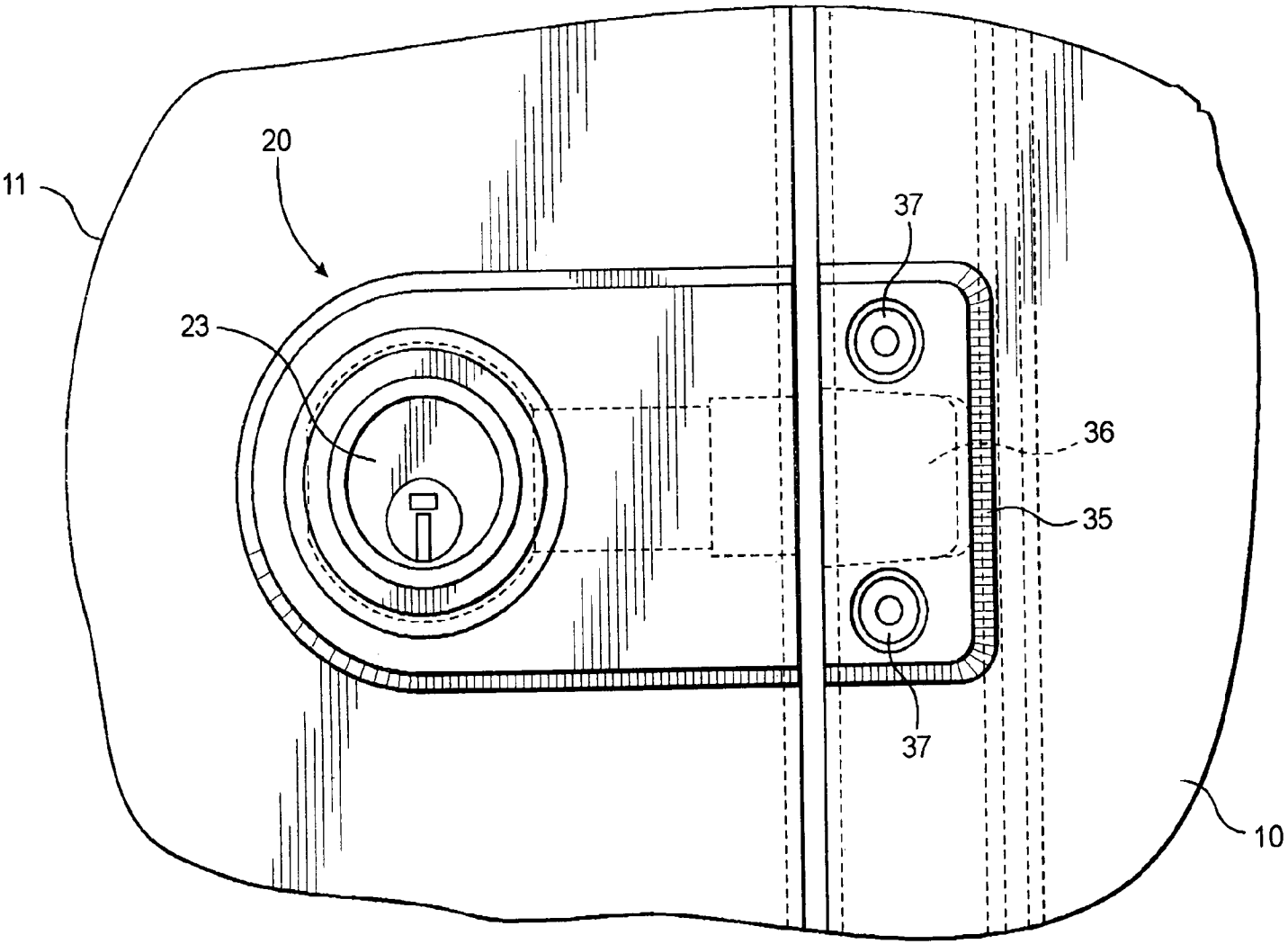
FIG. 2 is a front elevational view of a portion of the door and doorframe and lock mechanism shown in FIG. 1.

Referring now in more detail to the drawing, there is shown a portion of a door and doorframe of a walk-in freezer that comprises a door 10 hingedly mounted to a doorjamb 11. The side of the jamb that is shown is opposite the side to which the door is conventionally hinged. This side is simply a portion of the freezer wall that is adjacent to the door. The wall is seen to be of conventional construction in having a body of thermal insulation 13 in the form of a body of low thermally conductive composite plastic foam overlaid with sheet metal 14. The door is of similar construction comprising a body of plastic foam 15 encased in sheet metal 16. The door is seen in FIG. 3 to have a step to which a gasket 17 is mounted.

Figure 3:
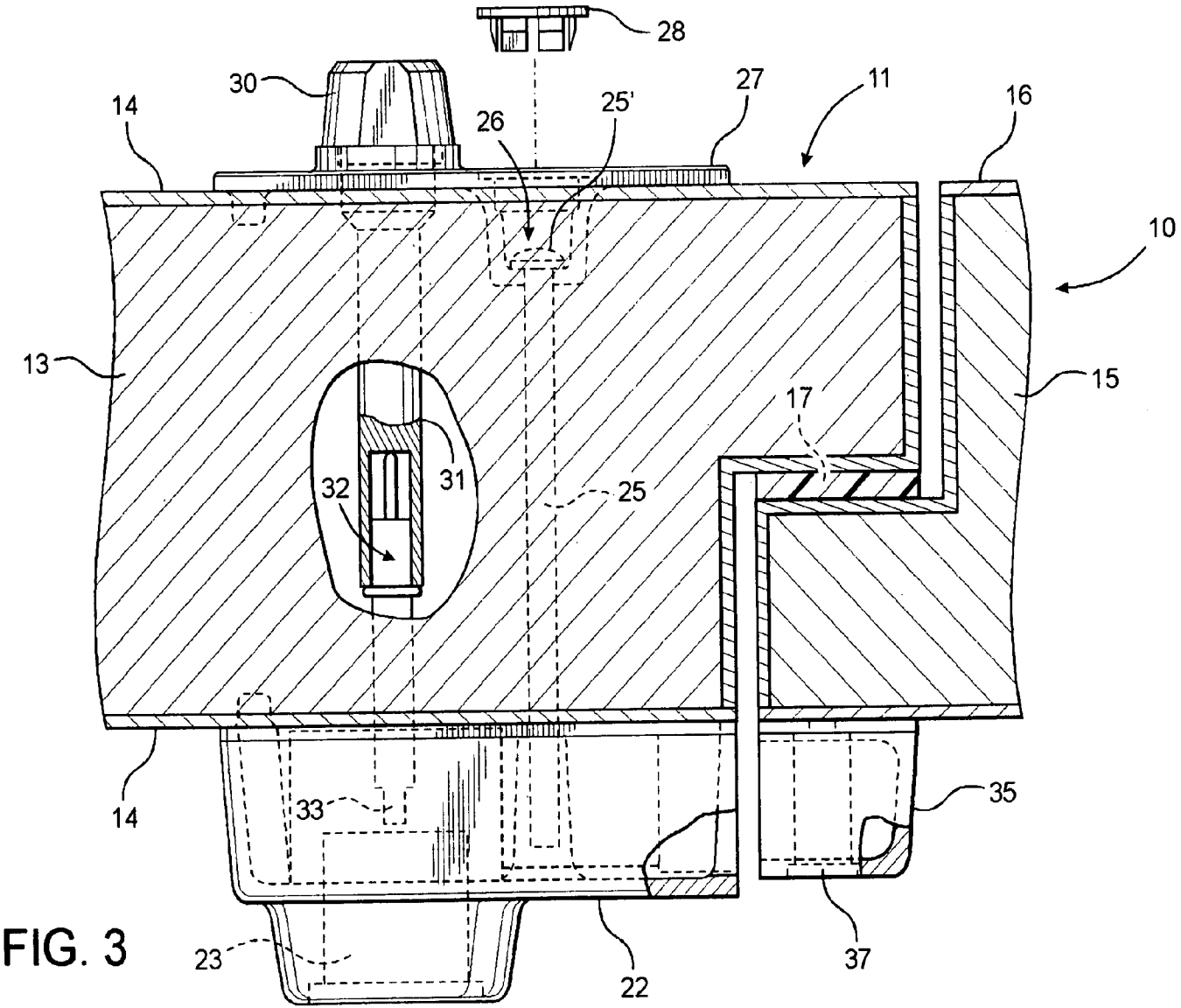
FIG. 3 is a cross sectional view thereof.
Figure 4:
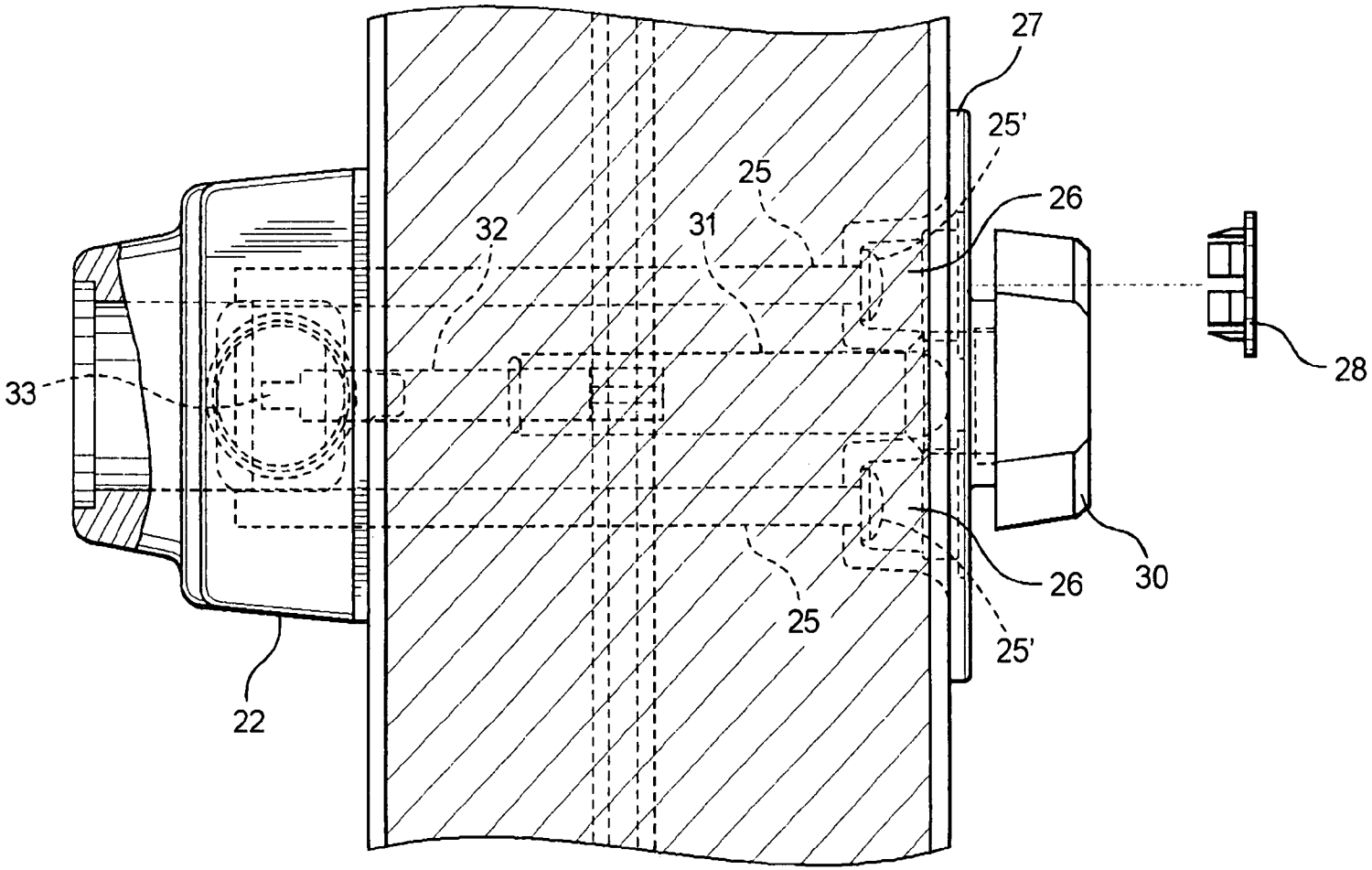
FIG. 4 is another cross sectional view thereof.
Figure 5:
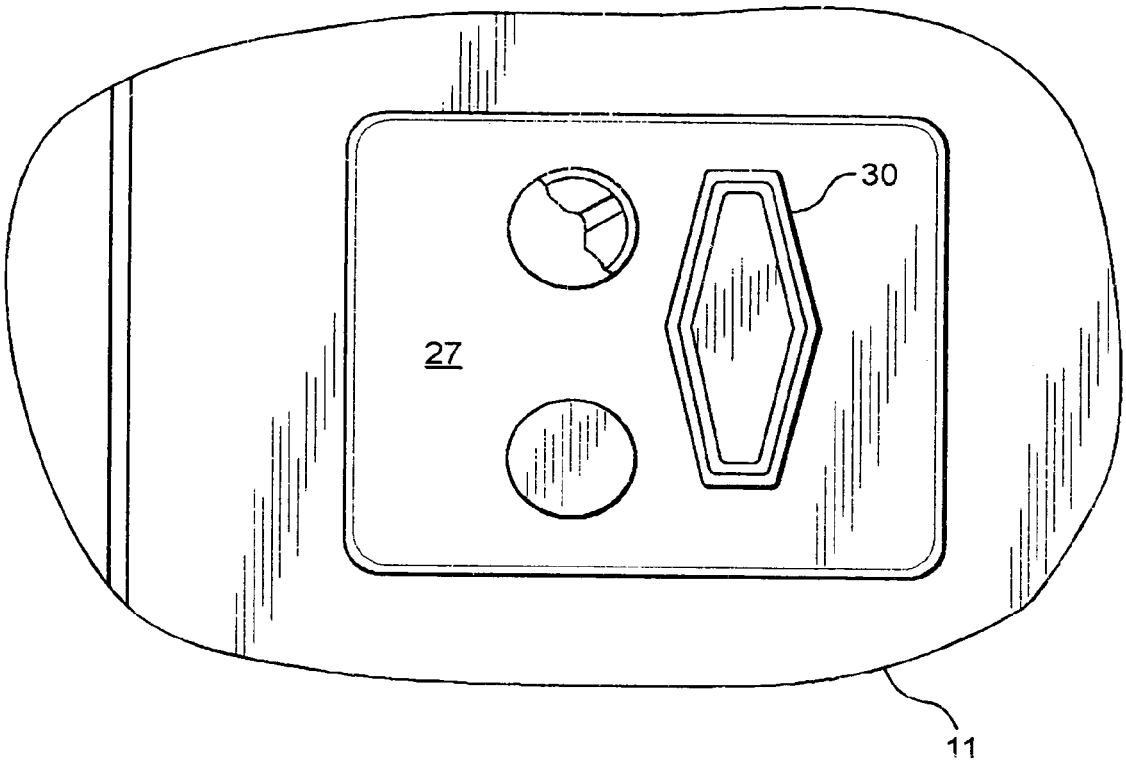
FIG. 5 is a rear elevational view thereof.

A lock is provided for locking the door in its closed position shown in FIG. 3. The lock includes a deadbolt assembly 20 that is of conventional construction but which is mounted to the doorjamb 11 rather than to the door 10. The deadbolt comprises a housing 22 to which a key cylinder 23 is mounted to reciprocate a cylindrical bolt 24 upon manual rotation of an unshown key inserted into the key cylinder. For clarity, the conventional operational mechanism that couples the key lock with the bolt is unshown. The housing 22 is mounted flush to the outside of the doorjamb 20 by two metallic mounting bolts 25 that are threaded into the housing. The mounting bolt heads 25' are run up against the bottom of two counterbored holes 26 of a mounting plate 27 that is mounted flushly to the inside of the jamb. The counterbored holes are covered by press-on caps 28 made of low thermal conduction ABS plastic to prevent cold air from circulating over the bolt heads. Thus the bolts are not exposed to the cold interior of the freezer.

The lock is also seen to be provided with means for operating the bolt from inside the cooler. This comprises a thumbscrew type handle 30 from which a shaft extends to the bolt operational mechanism. The shaft has a longitudinal portion 31 that extends from the handle 30 and a longitudinal portion 32 that extends from the mechanism. The shaft portion 31 is made of a low thermal conductive plastic and has a recess in its end that is distal to the handle 30. The portion 32 is metallic. One of its ends is captured within the end recess of the portion 31 while its other end has a spline 33 operatively connected with the bolt operation mechanism. This telescoping construction provides ease of adjustment for the accommodation of varying freezer wall thicknesses.

The lock also has a keeper 35 that is mounted to the outside of the door 10 in position to receive the bolt in its recess 36. The keeper is mounted to the door by bolts 37 within counter sunk bolt holes 38.

In operation the door 10 may be locked and unlocked in its closed position by operation of either the key cylinder 23 or the thumbscrew handle with minimal risk of freeze up. The deadbolt and its operation mechanism is thermally insulated by the unique construction of the handle shaft 31,32 that is rotatably located within the thermal insulation 13 of the doorjamb. That the deadbolt is on the stationary jamb also reduces the chances of water condensating and permeating the lock with the lock then freezing up.

It thus is seen that a new walk-in freezer door and doorframe, and lock therefor, is now provided that overcomes problems long associated with those of the prior art. Although the invention has been shown and described in its preferred form, it should be understood that many modifications, changes and additions may be made thereto without departure from the spirit and scope of the invention as set forth in the following claims.

What is claimed is:

1. A walk-in freezer door and doorframe system comprising a doorjamb having sheets of metal covering a body of thermal insulation, a door mounted to said doorjamb, a deadbolt housing mounted to the outside of said doorjamb, a deadbolt mounted for reciprocal movement within said housing between a door locked and a door unlocked position, a handle having a shaft non-rotatably affixed thereto, said handle rotatably positioned inside of said doorjamb from which said shaft extends into said deadbolt housing and into operative association with said deadbolt and with a longitudinal portion of said handle shaft being made of a low thermal conductive plastic; a mounting plate with at least one counterbored mounting hole to which said handle shaft rotatably extends, said mounting plate being mounted flush to the inside of said doorjamb by at least one metallic mounting bolt having a head mounted in said mounting plate counterbored mounting hole, a cap made of a low thermally conductive plastic mounted in said mounting plate counterbored hole covering said mounting bolt head; and a keeper mounted to said door in a position to receive said deadbolt with the door located within said doorjamb.

* * * * *